US008324146B2

(12) United States Patent
Zalk

(10) Patent No.: US 8,324,146 B2
(45) Date of Patent: Dec. 4, 2012

(54) SODIUM METASILICATE BASED CLEANING SOLUTIONS

(76) Inventor: Yehuda Zalk, Beer Sheva (IL)

( * ) Notice: Subject to any disclaimer, the term of this patent is extended or adjusted under 35 U.S.C. 154(b) by 0 days.

(21) Appl. No.: 13/220,855

(22) Filed: Aug. 30, 2011

(65) Prior Publication Data

US 2012/0142574 A1 Jun. 7, 2012

(51) Int. Cl.
*C11D 7/14* (2006.01)
*C11D 1/83* (2006.01)

(52) U.S. Cl. ..... 510/245; 510/251; 510/357; 510/365; 510/417; 510/426; 510/427; 510/432; 510/463; 510/470

(58) Field of Classification Search ..... 510/245, 510/251, 357, 365, 417, 426, 427, 432, 463, 510/470
See application file for complete search history.

(56) References Cited

U.S. PATENT DOCUMENTS

| | | | | |
|---|---|---|---|---|
| 3,879,216 | A * | 4/1975 | Austin | 134/4 |
| 4,414,128 | A * | 11/1983 | Goffinet | 510/405 |
| 4,528,039 | A * | 7/1985 | Rubin et al. | 134/2 |
| 4,540,505 | A * | 9/1985 | Frazier | 510/384 |
| 4,820,450 | A * | 4/1989 | Wile et al. | 134/13 |
| 5,158,710 | A * | 10/1992 | VanEenam | 510/264 |
| 5,498,805 | A * | 3/1996 | Koetzle | 568/827 |
| 6,432,892 | B2 | 8/2002 | Meine et al. | |
| 6,617,298 | B1 | 9/2003 | Morrow et al. | |
| 7,007,338 | B2 * | 3/2006 | Garabedian et al. | 15/231 |
| 7,527,060 | B2 | 5/2009 | Hood et al. | |
| 2002/0168422 | A1 * | 11/2002 | Hei et al. | 424/661 |
| 2004/0097390 | A1 * | 5/2004 | Jordan et al. | 510/189 |
| 2006/0248662 | A1 * | 11/2006 | Legrand | 8/405 |
| 2007/0179073 | A1 * | 8/2007 | Smith et al. | 510/197 |
| 2010/0184855 | A1 * | 7/2010 | Bernhardt et al. | 514/529 |
| 2010/0234269 | A1 | 9/2010 | Dreilinger et al. | |
| 2010/0305014 | A1 | 12/2010 | Miralles et al. | |
| 2011/0105377 | A1 | 5/2011 | Yianakopoulos et al. | |

FOREIGN PATENT DOCUMENTS

| | | |
|---|---|---|
| WO | WO2010138907 | 12/2010 |

* cited by examiner

*Primary Examiner* — Charles Boyer
(74) *Attorney, Agent, or Firm* — Mark M Friedman

(57) ABSTRACT

A cleaning solution used for cleaning oils and polluted industrial parts and a method for preparing cleaning solutions are disclosed. The cleaning solutions include (a) 1.0-5.5 wt-% alkali metasilicate agent, (b) 1.0-20.0 wt-% surface active agent, (c) 7.0-15.0 wt-% organic solvent, and (d) water. A method for preparing cleaning solutions includes the steps of (a) dissolving 1.0-8.0 wt-% alkali metasilicate powder in water forming a first solution, (b) dissolving 1.0-6.0 wt-% surface active agent and 7.0-20.0 wt-% organic solvent in a second solution, and (c) mixing the first and second solutions forming the cleaning solution.

1 Claim, 2 Drawing Sheets

SODIUM METASILICATE BASED CLEANING SOLUTIONS

FIELD OF THE INVENTION

The invention relates generally to cleaning solutions, and more particularly to sodium metasilicate based environmentally benign cleaning solutions.

BACKGROUND OF THE INVENTION

Cleaning agents specially made for removal of oils from substrates are called degreasers. These may be solvent based or solvent containing and may also have surfactants as active ingredients. The solvents have a dissolving action on grease and oils. The solvent containing degreaser may have an alkaline washing agent added to the solvent to promote further degreasing.

Alkaline washing agents contain strong bases like sodium hydroxide or potassium hydroxide. The alkali agents dissolve grease, oils, fats and protein based deposits. However, a disadvantage of the strong alkaline washing agents is that they are typically far from being environmentally benign. Alkaline washing agents are strong bases that need special storage and evacuation logistics and need to be deposited in secured authorized dumps.

There is therefore a need to provide highly efficient cleaning solutions for cleaning oils and polluted industrial parts that dissolve and dismantle heavy duty grease, oils and other organic pollutants. Furthermore, there is a need to provide cleaning solutions that will be hazard free and environmentally benign. It would be highly advantageous to provide such environmentally benign cleaning solutions that may be dumped in sewage systems and may be cost effectively treated and reused.

SUMMARY OF THE INVENTION

A cleaning solution used for cleaning oils and polluted industrial parts and a method for preparing cleaning solution are disclosed. According to the embodiments of the present invention the cleaning solution includes at least 1.0-5.5 wt-% alkali metasilicate agent, 1.0-15.0 wt-% surface active agent, 7.0-20.0 wt-% organic solvent, and water.

According to a further feature of an embodiment of the present invention, the alkali metasilicate agent may be selected from the group including: sodium metasilicate and potassium metasilicate.

According to a further feature of an embodiment of the present invention, the sodium metasilicate agent may be sodium metasilicate pentahydrate.

According to a further feature of an embodiment of the present invention, more than 5 water molecules may solvate each sodium metasilicate agent molecules.

According to a further feature of an embodiment of the present invention, dissolved cations of the alkali metasilicate agent are operative to crack oil carbon chains into smaller hydrocarbons in the cleaning solution.

According to a further feature of an embodiment of the present invention, dissolved metasilicate anions are operative to emulsify and solvate the cracked smaller hydrocarbons in the cleaning solution.

According to a further feature of an embodiment of the present invention, the cleaning solution surface active agent may be alkyl polyglucoside.

According to a further feature of an embodiment of the present invention, the cleaning solution organic solvent may be selected from the group including: dipropyleneglycol monomethyl ether and butyl glycol ether.

According to a further feature of an embodiment of the present invention, the cleaning solution may have a PH between about 12 and about 13.

According to a further feature of an embodiment of the present invention, the cleaning solution may further include 0.1-5.0 wt-% water softener agent.

According to a further feature of an embodiment of the present invention, the water softener agent may be selected from the group including: sodium tripolyphosphate and tetra potassium pyrophosphate.

According to a further feature of an embodiment of the present invention, the cleaning solution may include 0.1-5.0 wt-% anti oxidant agent.

According to a further feature of an embodiment of the present invention, the anti oxidant agent may be sodium meta bisulfite.

According to a further feature of an embodiment of the present invention, the cleaning solution may include 2.0-5.0 wt-% soap agent.

According to a further feature of an embodiment of the present invention, the soap agent may be selected from the group including: sodium coceth-30 sulphate, palm oil, coconut oil and olive oil soap bases.

According to a further feature of an embodiment of the present invention, a method for preparing cleaning solution includes the steps of: dissolving 1.0-5.5 wt-% alkali metasilicate agent, 1.0-20.0 wt-% surface active agent solution and 7.0-15.0 wt-% organic solvent solution in water; and (b) mixing the solution forming the cleaning solution.

According to a further feature of an embodiment of the present invention, the step of dissolving the alkali metasilicate agent, the surface active agent and the organic solvent may include: (i) dissolving the alkali metasilicate powder in water forming a first solution, (ii) dissolving the surface active agent and the organic solvent in water in a second solution.

According to a further feature of an embodiment of the present invention, the alkali metasilicate agent may be selected from the group consisting of: sodium metasilicate and potassium metasilicate.

According to a further feature of an embodiment of the present invention, the organic solvent may be selected from the group consisting of: dipropyleneglycol monomethyl ether and butyl glycol ether.

According to a further feature of an embodiment of the present invention, the method may further include the step of dissolving 1.0-3.0 wt-% water softener agent.

According to a further feature of an embodiment of the present invention, the water softener agent may be selected from the group including: sodium tripolyphosphate and tetra potassium pyrophosphate.

According to a further feature of an embodiment of the present invention, the method includes the step of dissolving 2.0-5.0 wt-% anti oxidant agent According to a further feature of an embodiment of the present invention, the anti oxidant agent may be sodium meta bisulfite.

According to a further feature of an embodiment of the present invention, the method may include the step of dissolving 2.0-5.0 wt-% soap agent.

According to a further feature of an embodiment of the present invention, the soap agent may be selected from the group including: sodium coceth-30 sulphate, palm oil, coconut oil and olive oil soap bases.

According to a further feature of an embodiment of the present invention, the method may include further dissolving sodium tripolyphosphate and sodium bisulphite in the first solution.

According to a further feature of an embodiment of the present invention, the method may include further dissolving sodium tripolyphosphate and sodium bisulphite in the first solution.

According to a further feature of an embodiment of the present invention, the step of dissolving the sodium meta silicate powder, sodium tripolyphosphate and sodium bisulphite in the first solution is performed in a first vessel using a mixer for about one hour and at a speed of about 1500 rotations per minute.

According to a further feature of an embodiment of the present invention, the step of dissolving the surface active agent and the organic solvent in the second solution is performed in a second vessel using a mixer for about half an hour at a speed of about 20 to 30 rotations per minute.

According to a further feature of an embodiment of the present invention, the step of mixing the solution is performed in a third vessel using a mixer at a speed of about 1500 rotations per minute for about half an hour forming a clear cleaning solution According to a further feature of an embodiment of the present invention, the method may include further the step of adding 0.1-3.0 wt-% limonene and 1.0-10.0 wt-% sodium coceth-30 sulphate to the cleaning solution during mixing.

According to a further feature of an embodiment of the present invention, a cleaning solution includes: 10.0-80 wt-% water, 4.0-7.0 wt-% sodium meta silicate pentahydrate, 0.1-2.0 wt-% sodium tripolyphosphate, 0.1-2.0 wt-% sodium meta bisulfite, 1.0-6.0 wt-% alkyl polyglucoside, 5.0-15 wt-% dipropyleneglycol monomethyl ether, and 0.1-3.0 wt-% limonene.

According to a further feature of an embodiment of the present invention, the cleaning solution may further include 1.0-10.0 wt-% sodium coceth-30 sulphate.

According to a further feature of an embodiment of the present invention, a method of cleaning oils off a substrate is disclosed. The method may include the steps of (a) providing a cleaning solution comprising (i) 1.0-5.5 wt % alkali metasilicate agent, (ii) 1.0-20.0 wt % surface active agent, (iii) 7.0-15.0 wt % organic solvent, and (iv) water; and (b) applying the cleaning solution to the substrate.

According to a further feature of an embodiment of the present invention, the cleaning solution, having been applied to the oils, is operative to (i) dissolve the oils, (ii) crack the oils carbon chains to smaller hydrocarbons. and (iii) solvate and emulsify the cracked smaller hydrocarbons in the cleaning solution.

According to a further feature of an embodiment of the present invention, a method of cleaning polluted industrial parts is disclosed. The method may include the steps of: (a) providing a cleaning solution comprising (i) 1.0-5.5 wt % alkali metasilicate agent, (ii) 1.0-20.0 wt % surface active agent, (iii) 7.0-15.0 wt % organic solvent, and (iv) water; and (b) applying the cleaning solution to the polluted industrial parts.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF THE PREFERRED EMBODIMENTS

Figure 1C:
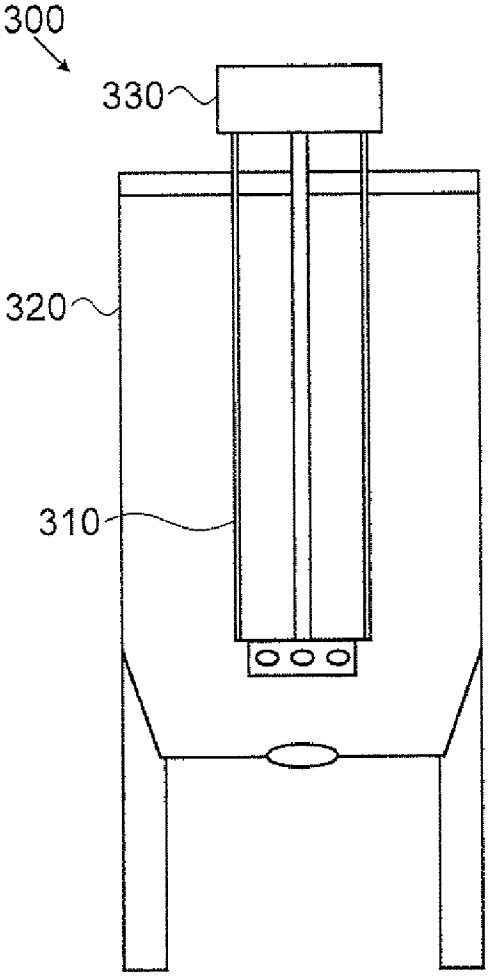
FIG. 1C illustrates an homogenizer mixer system used to mix the first and second solutions, according to an embodiment of the present invention.

As used herein, the term "wt-%", refers to the concentration of a substance as the weight of that substance divided by the total weight of the solution.

Certain embodiments of the present invention provide a sodium meta silicate based cleaning solutions used for cleaning oils from substrates and polluted industrial parts and methods for preparing cleaning solutions. According to a further aspect of the present invention, the cleaning solutions may be comprised of other alkali metasilicate agent, such as potassium metasilicate, substituting the sodium metasilicate agent.

It has surprisingly been found by the present inventor that a cleaning solution, comprised in a certain embodiment, expressed by relative weights: water 10.0-80% wt—(and preferably wt—70%), sodium metasilicate pentahydrate 4.0-5.5% wt—(and preferably wt—5.5%), sodium tripolyphosphate (STPD) 0.1-2.0% wt—(and preferably 0.4%) (wt—0.4%), sodium metabisulfite 0.1-2.0% wt—(and preferably 0.6%), alkyl polyglucoside 1.0-6.0% wt-% (and preferably 3.0%), dipropylene glycol monomethyl ether (DPGME) 5.0-15% wt—(and preferably 12.0%), Limonene 0.1-3.0% wt—(and preferably 1.5%) and sodium coceth-30 sulfate 1.0-10.0% wt—(and preferably 7.0%), is an excellent, environmentally benign, cleaning solution that may be used as a degreaser solution operative to dissolve and to dismantle heavy duty grease and oils from substrates.

Not wishing to be bound by a theory, it is suggested that dissolved sodium cations crack carbon chains into smaller hydrocarbons and metasilicate anions emulsify and solvate the cracked smaller hydrocarbons in the cleaning solution.

According to embodiments of the present invention, the provided environmentally benign cleaning solution is a clear, brownish solution with PH range of about 12 to 13. The present invention cleaning solution is an excellent agent for removal of oils where the cleaning solution that dissolved and dismantled oil materials may be dumped to a regular sewage system, and may be cost effectively desalinated and reused for agricultural irrigation and thus it is an environmentally benign degreaser.

Chemical ingredients that may be used to comprise the present invention cleaning solutions are listed herein below:

Sodium metasilicate pentahydrate, (CAS 10213-79-3, Formula $SiO_3Na_2.5H_2O$) form strongly alkaline solution when solved in water. According to embodiments of the present invention, sodium cations in the solution are operative to crack carbon chains into smaller hydrocarbons that are further emulsified and solvated in the cleaning solution by the metasilicate anions.

Sodium metabisulfite (CAS 7681-57-4, Formula $Na_2S_2O_5$) is a white to slightly yellowish crystalline powder with sulfur dioxide odor, readily soluble in water. Bisulfite is a reductive bleaching agent used as anti oxidant agent in chemical manufacturing.

Dipropylene glycol monomethyl Ether (DPGME) (CAS 34590-94-8, Formula $CH_3(OC_3H_6)_2OH$) is a colorless, viscous, practically non-toxic and slightly hygroscopic liquid. DPGME is a mixture of 4 isomers and is used in a wide variety of industrial and commercial products.

Sodium Coceth-30 Sulfate (CAS 68891-38-3, Formula) is a natural soap.

Limonene (CAS 5989-27-5, Formula $C_{10}H_{16}$) is a colorless liquid hydrocarbon.

Sodium tripolyphosphate (STPP, CAS 7758-29-4, Formula $Na_5P_3O_{10}$) is an inorganic compound. It binds strongly to metal cations as both a bidentate and tridentate chelating agent and is used as a salt reducing, water softener agent.

Alkyl polyglucosides (APGs) are new generation environmentally friendly non ionic surface active agents.

According to a further aspect of the present invention, certain embodiments provide a method for preparing a cleaning solution. The method comprising the steps of (a) dissolving sodium meta silicate pentahydrate powder in water forming a first solution, (b) dissolving a surface active agent such as alkyl polyglucoside and an organic solvent such as dipropyleneglycol monomethyl ether powders in water forming a second solution, (c) mixing the first and second solutions forming a clear, brownish cleaning solution.

According to a further aspect of the present invention, the method for preparing a cleaning solution comprising the steps of (a) dissolving sodium meta silicate pentahydrate agent, sodium tripolyphosphate water softener agent and sodium metabisulfite reductive bleaching anti oxidant agent powders in water forming a first solution, (b) dissolving alkyl polyglucoside surfactant and dipropylene glycol monomethyl ether organic solvent liquids in water forming a second solution, (c) mixing said first and second solutions, and (d) adding limonene and sodium coceth-30 sulfate soaps to the mixed solution forming a clear and brownish cleaning solution.

The various aspects of the invention will be illustrated herein primarily by reference to a non-limiting example of a method for preparing a sodium meta silicate based cleaning solution, but it will be appreciated that the various aspects of the present invention are equally applicable to a wide range of other cleaning solutions.

The cleaning solution may be produced in three steps as illustrated in FIGS. 1, A, 1B and 1C below.

Figure 1B:
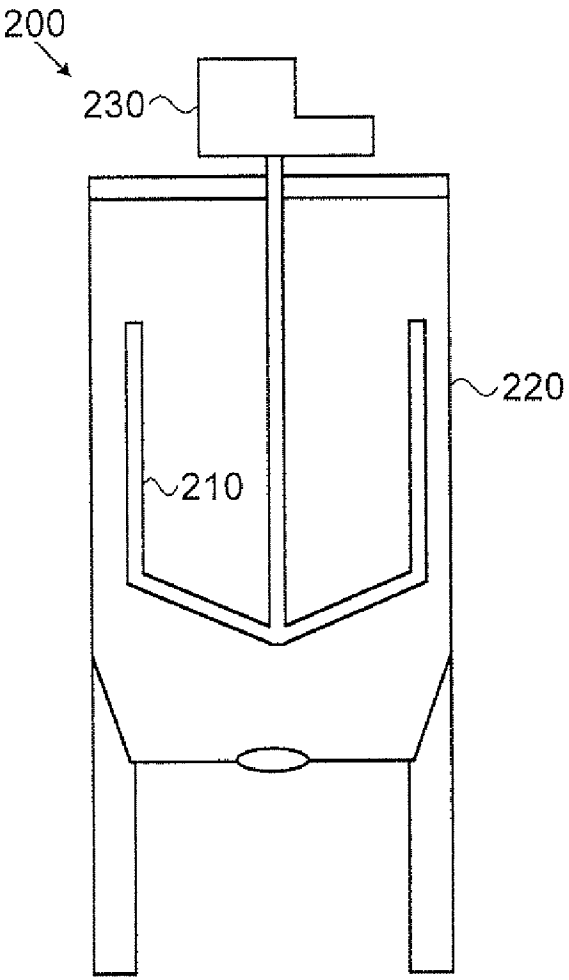
FIG. 1B illustrates an anchor propeller mixer system used to prepare a second solution, according to an embodiment of the present invention.
Figure 1A:
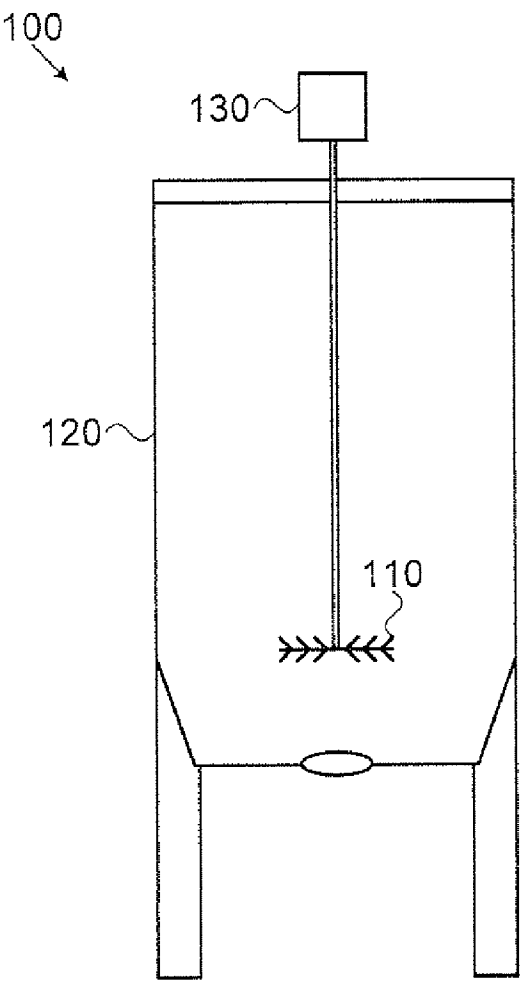
FIG. 1A illustrates a disc propeller mixer system used to prepare a first solution, according to an embodiment of the present invention.

FIG. 1A illustrates a disc propeller mixer system used to prepare a first solution according to an embodiment of the present invention. The disc propeller mixer system 100 includes a disc propeller 110 a vessel 120 and an engine 130. In the first step, at least sodium meta silicate pentahydrate powder is dissolved in water in vessel 120 forming a first solution (other additives may be dissolved in this step). The disc propeller mixer 110 is turned on for one hour and at a speed of about 1500 rotations per minute to dissolve the powder and after that the clear solution is kept for another six hours to ensure that the sodium meta silicate pentahydrate powder is fully dissolved and that no sediments are formed.

According to embodiments of the present invention sodium metasilicate powders or solutions with more than 5 water molecules, solvating each sodium metasilicate molecule, may be used and are within the scope of the present invention.

According to a further aspect of the present invention, sodium tripolyphosphate water softener agent and sodium metabisulfite anti oxidant agent powders may be added to vessel 120 and dissolved in the first solution in the first step described in FIG. 1A. Sodium tripolyphosphate (STPD) may be dissolved in the present invention cleaning solution as a water softener. According to embodiments of the present invention, other anti oxidants and/or water softener agents may be used and sodium tripolyphosphate and sodium meta bisulfate are merely non limiting examples of such anti oxidants and water softener agents.

FIG. 1B illustrates an anchor type propeller mixer system used to prepare a second solution, according to an embodiment of the present invention. The anchor propeller mixer system 200 includes an anchor propeller 210 a vessel 220 and an engine 230 that mix the liquid at speed of about 1500 rotations per minute. In the second step, alkyl polyglucoside and dipropylene glycol monomethyl ether liquids are dissolved in water in vessel 220 forming a second solution. The anchor propeller mixer 210 is turned on for half an hour to mix the liquids at slow speed of about 20 to 30 rotations per minute.

FIG. 1C illustrates a homogenizer mixer system used to mix the first and second solutions, according to an embodiment of the present invention. The homogenized propeller mixer system 300 includes a homogenizer propeller 310 a vessel 320 and an engine 330. In the third step, the two solutions prepared as described in steps 1 and 2 herein above, are slowly mixed in vessel 320 by the homogenizer propeller 310 with no more than 1500 rotations per minute forming a clear, brownish cleaning solution (other additives may be dissolved in this step). According to a further aspect of the present invention, limonene and sodium coceth-30 sulfate natural soap may be added to vessel 320 and the solution may be mixed further for an additional half an hour using the homogenizer propeller 310.

Figure 2:
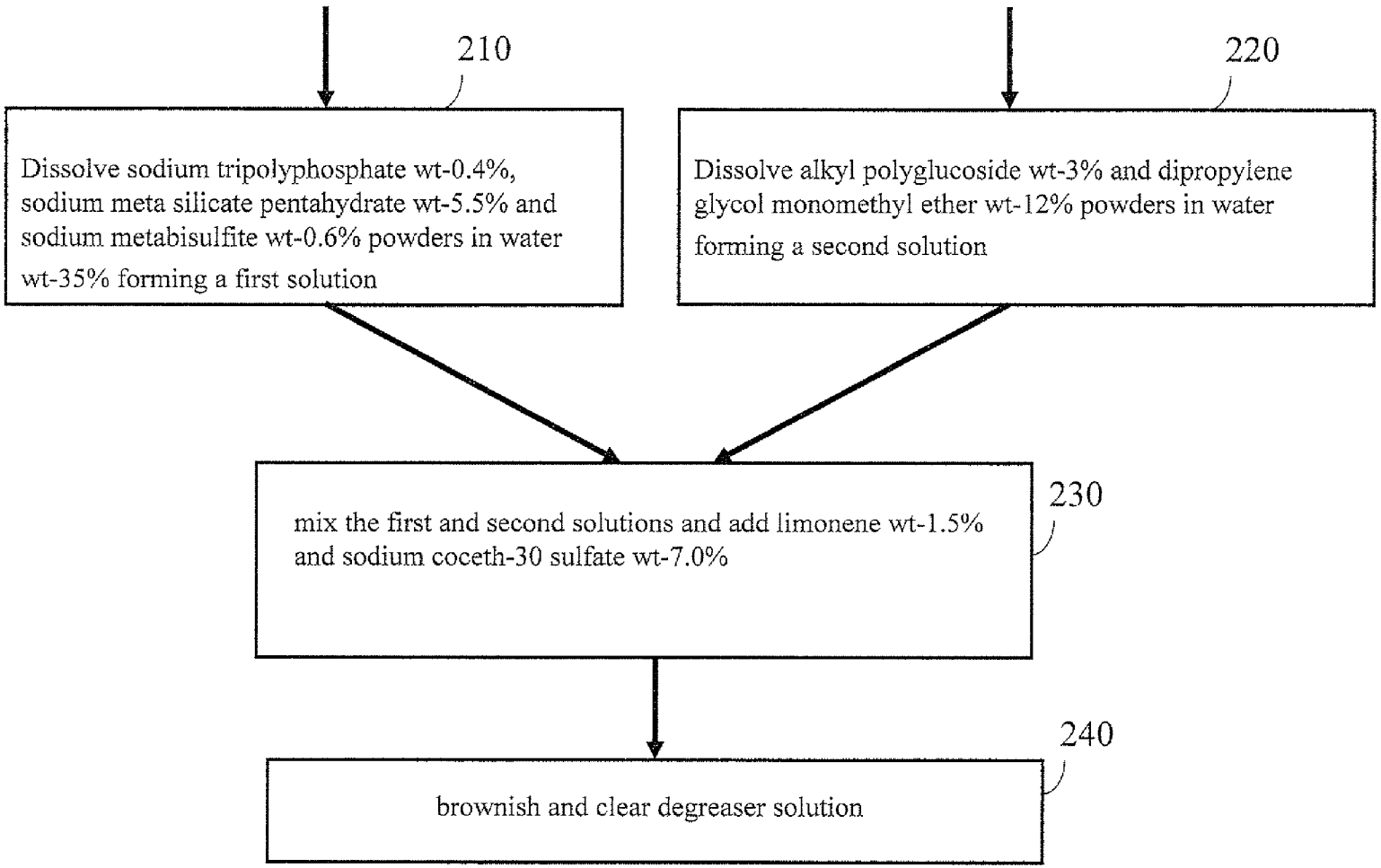
FIG. 2 illustrates a method for preparing a cleaning solution in a flow chart, according to embodiments of the present invention.

FIG. 2 illustrates a method for preparing a cleaning solution in a flow chart, according to embodiments of the present invention. The method comprising the steps of (a): dissolving about wt—5.5% sodium meta silicate pentahydrate, about wt—0.4% sodium tripolyphosphate and about wt—0.6% sodium meta bisulfate in wt—35% water in first solution in vessel 210. Dissolving about wt—3.0% alkyl polyglucoside and wt—12.0% dipropyleneglycol monomethyl ether (DPGME) in wt—35% water in a second solution in vessel 220. Mixing the first and second solutions in a third vessel 230 and adding about wt—1.5% limonene and about wt—7.0% sodium coceth-30 sulphate forming a clear, brownish cleaning solution. According to embodiments of the present invention, palm oil, coconut oil and/or olive oil soap bases may be used as replacements or as additives to limonene and sodium coceth-30 sulphate.

The method for preparing the cleaning solution described herein above is an embodiment of the present invention and in other embodiments other method steps such as dissolving 1.0-5.5 wt-% alkali metasilicate agent, 1.0-20.0 wt-% surface active agent solution and 7.0-15.0 wt-% organic solvent solution in water in a first step and mixing the solution forming the cleaning solution in a second step may be implemented and are in the scope of the present invention.

According to further embodiments of the present invention, butyl glycol ether may be added to the cleaning solution as an additive or as a replacement to dipropylene glycol monomethyl ether.

According to embodiments of the present invention, the cleaning solution has a PH of about 12 to 13, however the PH range of 12 to 13 is a preferable range but non limiting range and other PH ranges for the cleaning solution may be used according to embodiments of the present invention.

According to embodiments of the present invention, and not wishing to be bound by a theory, the inventor of the present invention has found that sodium metasilicate pentahydrate content should be less than wt—5.5% in weight and DPGME content should be less than wt—15% in weight to keep the solution in the PH range of 12 to 13 and to obtain an excellent and clear cleaning solution.

According to further embodiments of the present invention, sodium metasilicate based cleaning solutions may be used for cleaning polluted industrial parts such as, but not limited to, printing device parts including printing heads. The cleaning solutions include water 50.0-80% wt—(and preferably wt—68.3%), sodium tripolyphosphate (STPD) 0.1-2.0% wt—(and preferably wt—0.2%), sodium metasilicate pentahydrate 1.0-5.5% wt—(and preferably wt—2.0%), sodium metabisulfite 0.1-5.0% wt—(and preferably 3.0%), alkyl polyglucoside 1.0-15.0% wt-% (and preferably 10.0%), dipropylene glycol monomethyl ether (DPM) 10.0-20% wt—(and preferably 15.0%), Limonene 0.1-3.0% wt—(and preferably 1.5%).

Advantageously, the present invention sodium metasilicate based solution is an extremely efficient environmentally benign cleaning solution operative to crack carbon chains of the dissolved oils to smaller hydrocarbons chains and to solvate and emulsify the cracked smaller hydrocarbons in the solution.

Another advantage of the cleaning solution described above is that, the cleaning solution that includes the dissolved and cracked oils may be dumped to a regular sewage system, to be cost effectively desalinated and reused for agricultural irrigation.

Another advantage of the cleaning solution described above is that it may be stored in containers for several years without deterioration in performance.

Another advantage of the cleaning solution described above is that the method for preparing the cleaning solution is straightforward, simple and inexpensive.

Furthermore, the present invention cleaning solution may be used for other cleaning tasks such as cleaning polluted industrial parts, such as printer device parts including printing heads, containers, tankers in ships, trains and trucks and for home cleaning. Any other cleaning applications wherein the cleaning solutions of embodiments of the present invention may be used also fall within the scope of the present invention.

Furthermore, the present invention cleaning solution with sodium metasilicate pentahydrate content of less than wt—5.5% in weight and DPGME content of less than wt—15% in weight are excellent cleaning solution with clear brownish color.

In summary, the cleaning solutions of the present invention improve the prior art cleaning solutions by introducing environmentally benign sodium metasilicate based cleaning solutions operative to crack carbon chains of the dissolved oils into smaller hydrocarbons and to solvate the cracked smaller hydrocarbons and may be used as a degreaser and as a cleaning solution for polluted industrial parts.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof, which would occur to persons skilled in the art upon reading the foregoing description. While preferred embodiments of the present invention have been shown and described, it should be understood that various alternatives, substitutions, and equivalents can be used, and the present invention should only be limited by the claims and equivalents thereof.

What is claimed is:

1. A cleaning solution comprising:

(a) 10.0-80 wt-% water;

(b) 1.0-5.5 wt-% sodium meta silicate pentahydrate;

(c) 0.1-2.0 wt-% sodium tripolyphosphate;

(d) 0.1-2.0 wt-% sodium meta bisulfite;

(e) 1.0-6.0 wt-% alkyl polyglucoside;

(f) 1.0-10.0 wt-% sodium coceth-30 sulphate;

(g) 5.0-15 wt-% dipropyleneglycol monomethyl ether; and (h) 0.1-3.0 wt-% limonene.

* * * * *